US005462095A

United States Patent [19]

Okesaku

[11] Patent Number: 5,462,095

[45] Date of Patent: Oct. 31, 1995

[54] PICKING DEVICE WITH SELECTED SPOOLS FOR A WATER-JET LOOM

[75] Inventor: Masahiro Okesaku, Ishikawa, Japan

[73] Assignee: Hokuriku Seikei Industrial Co., Ltd., Ishikawa, Japan

[21] Appl. No.: 190,821

[22] Filed: Feb. 2, 1994

[30] Foreign Application Priority Data

| | | | |
|---|---|---|---|
| Feb. 8, 1993 | [JP] | Japan | 5-044469 |
| Apr. 30, 1993 | [JP] | Japan | 5-103948 |
| Nov. 19, 1993 | [JP] | Japan | 5-338757 |

[51] Int. Cl.[6] ..... D03D 47/32

[52] U.S. Cl. ..... 139/435.4; 239/61; 239/583

[58] Field of Search ..... 239/583, 61; 139/435.4

[56] References Cited

U.S. PATENT DOCUMENTS

| | | | |
|---|---|---|---|
| 3,633,808 | 1/1972 | Svaty | 139/435.4 |
| 4,105,053 | 8/1978 | Fajfr | 139/435.4 |
| 4,326,565 | 4/1982 | Van Mullekom | 139/435.4 |
| 4,542,772 | 9/1985 | Gaschutz | 139/435.4 |
| 4,669,514 | 6/1987 | Manders | 139/435.4 |
| 4,850,398 | 7/1989 | Van Bogaert | 139/435.4 X |
| 5,109,891 | 5/1992 | Maina | 139/435.4 |
| 5,119,863 | 6/1992 | Okesaku et al. | 139/435.4 |

*Primary Examiner*—Andrew M. Falik
*Attorney, Agent, or Firm*—Jordan and Hamburg

[57] ABSTRACT

A picking device for a water-jet loom comprises a nozzle body connected to a pressurized water source and provided with a plurality of axial nozzle holes, a plurality of spools fitted respectively in the axial nozzle holes and each provided with an axial through-hole through which to pass a weft yarn, a spool driving mechanism for individually or sequentially driving the spools for axial reciprocation or for turning alternately in opposite directions within a fixed angular range, and orifice chips having orifices defining straightening spaces for straightening the flow of the pressurized water around the front ends of the spools together with the circumferences of the front ends of the spools. A fluid passage connected to each of the orifices can be opened and closed by axial reciprocation or by turning alternately in opposite directions in the given angular range of the spool. The spools may be fixedly fitted in the axial nozzle holes, and the fluid passages connected respectively to the orifices may be opened and closed by a valve mechanism driven by a valve driving mechanism.

8 Claims, 13 Drawing Sheets

PICKING DEVICE WITH SELECTED SPOOLS FOR A WATER-JET LOOM

BACKGROUND OF THE INVENTION

1. Field of the Invention

This invention relates to a picking device for a water-jet loom and, more particularly, to a picking device capable of picking a plurality of different kinds of weft yarns in sequence or periodically.

2. Description of the Prior Arts

A water-jet loom needs a plurality of fluid passages and a fluid passage selecting device, such as a selector valve, for selectively supplying a pressurized fluid to the plurality of fluid passages to pick a plurality of different kinds of weft yarns in sequence or periodically.

As shown in FIG. 21, by way of example, in a conventional water-jet loom disclosed in Japanese Utility Model Unexamined Publication (Kokai) No. 63177975, two picking devices 101*a* and 101*b* are disposed close to each other, the picking devices 101*a* and 101*b* are connected to an electromagnetic or mechanical selector valve 103 respectively by water supply lines 102*a* and 102*b*, and the selector valve 103 is connected to a pump 100.

Generation of a high-velocity water jet is essential to enable a-water-jet loom to operate at a high weaving speed. A water-jet loom needs only one picking device and one water supply line if the loom uses a single kind of weft yarn, and so the water supply system of the water-jet loom need not be provided with any selector valve and requires only a comparatively simple control operation. Generally, such a water-jet loom provided with a single picking device is provided with a pump having a pressure capacity in the range of 70 to 80 kg/cm$^2$ and is capable of operating at 1200 rpm, i.e., 1200 picking cycles per minute, at maximum.

A water-jet loom that uses a plurality of kinds of weft yarns needs a water supply system provided with a plurality of water supply lines respectively for the plurality of different kinds of weft yarns and, as shown in FIG. 21, a selector valve. Pressure loss in the pressurized water due to the frictional resistance of the pipes forming the water supply lines and the resistance of the restrictive portions of the selector valve against the flow of water is not ignorable. If the pressure loss is excessive, sufficient water cannot be supplied to each picking device. The maximum pressure capacity of a pump suitable for use on the conventional water-jet loom provided with a plurality of picking devices is on the order of 140 kg/cm$^2$, the maximum weaving speed of the conventional water-jet loom is on the order of 700 rpm, and the water-jet loom provided with a plurality of picking devices consumes 1 to 1.3 cm$^3$/pick (1 ton/day) more water than a water-jet loom provided with a single picking device.

The water-jet loom capable of picking a plurality of kinds of weft yarns in sequence or periodically needs a pump with a considerably large pressure capacity, inevitably entailing an increase in power consumption and pump noise, and a reduction in the functional lives of the pump and the selector valve due to enhanced abrasion. Other problems are that water hammer occurs when the selector valve changes the water supply line, damaging the weft yarn, and that the operating costs, including power and water cost, are very high.

In the conventional water-jet loom, the picking devices and the peripheral parts have complicated constructions, and so it is difficult to provide the water-jet loom with three or more picking devices due to the geometrical relation between the picking devices and the size of the shed.

Still further, since the conventional water-jet loom provided with a plurality of picking devices has a plurality of water supply lines and a selector valve supplying water selectively and sequentially to the water supply lines, water supplied to one water supply line leaks into another water supply line. This means that insufficient water is supplied to the former water supply line, which often entails short pick or bent pick.

SUMMARY OF THE INVENTION

Accordingly, it is an object of the present invention to provide a compact picking device for a water-jet loom, having a simple construction and capable of efficiently carrying out a high-speed picking operation without entailing a short pick or bent pick.

A picking device for a water-jet loom in one aspect of the present invention comprises a nozzle body connected to a pressurized fluid source and is provided with at least two axial nozzle holes, at least two axially slidable spools fitted in the axial nozzle holes of the nozzle body and each provided with an axial hole through which to pass a weft yarn, a spool driving mechanism for individually or sequentially reciprocating the spools along their axes, and orifice chips having orifices defining straightening spaces for straightening the flow of the pressurized fluid around the front ends of the spools together with the circumferences of the spools. A fluid passage connected to each of the orifices can be opened and closed by the axial movement of the corresponding spool.

The spools may be individually or sequentially turned on their axis by a spool driving mechanism to open and close the pressurized fluid passages connected to the orifices of the orifice chips.

The nozzle body may be provided with a pair of sleeves capable of holding the spools in an axially slidable position and inlet ports may be formed in a wall separating the pair of sleeves or in one of the sleeves to allow pressurized fluid supplied from the pressurized fluid source to flow into the orifices therethrough.

Each sleeve may be incorporated into the nozzle body opposite the front end of the spool, and an orifice member integrally provided with the sleeves may be incorporated into the nozzle body.

It is also possible to employ, instead of the spools capable of being movable in its axial direction and rotatable on its axis, a nozzle body provided with a single inlet hole to be connected to the pressurized fluid source, a plurality of fixed spools disposed within the nozzle body, a valve mechanism for selectively connecting passages from the inlet hole of the nozzle body to the circumferences of the spools, and a valve driving mechanism for driving the valve mechanism. The spools may be arranged with their axes intersecting each other so that water jets jetted through the nozzle holes of the fixed spools meet at a predetermined position.

Since the supply of the pressurized fluid to the spool can be interrupted by axially moving the spool in the nozzle body, the picking device need not be provided with any selector valve. Since pressure loss in the pressurized fluid occurs only when the pressurized fluid is subjected to straightening by the straightening orifice immediately before being discharged to pick a weft yarn and pressure loss in the pressurized fluid passage between the pump and the picking device is negligible, the weft yarn can be picked at a high picking speed by a high-velocity pressurized fluid jet.

Since the piping system need not be provided with a selector valve, the picking device and the piping system can be arranged near the picking position and the picking device can be effectively used in combination with a multiple-color loom.

The picking device provided with the fixed spools and the valve mechanism for selectively connecting the fixed spools to the pressurized fluid inlet of the nozzle body is capable of picking a weft yarn at a high picking speed. The picking device may be constructed so that respective directions of the axes of the fixed spools are adjustable to change the directions of the axes of the fixed spools according to the width of the fabric to be woven on the water-jet loom.

BRIEF DESCRIPTION OF THE DRAWINGS

The above and other objects, features and advantages of the present invention will become more apparent from the following descriptions taken in connection with the accompanying drawings, in which.

DETAILED DESCRIPTION OF THE PREFERRED EMBODIMENTS

First Embodiment

Figure 2:
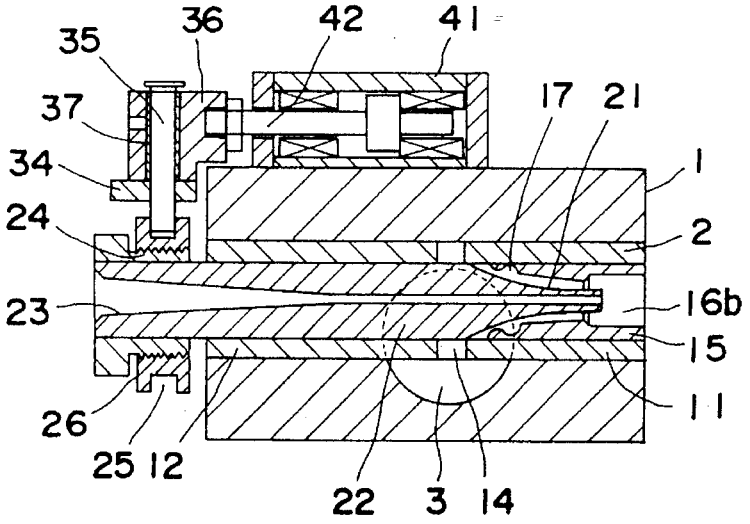
FIG. 2 is a sectional view taken on line A—A in FIG. 1.
Figure 3:
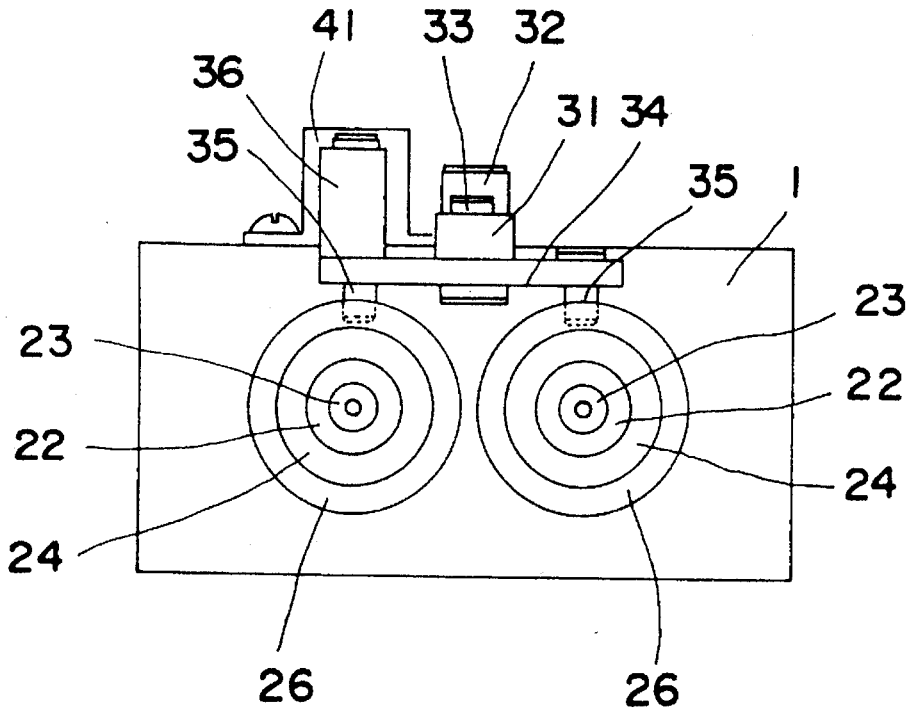
FIG. 3 is a left side view of the picking device of FIG. 1.
Figure 4:
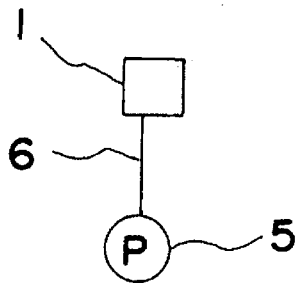
FIG. 4 is a diagrammatic view of a piping system connecting a pump to the picking device of FIG. 1.
Figure 5:
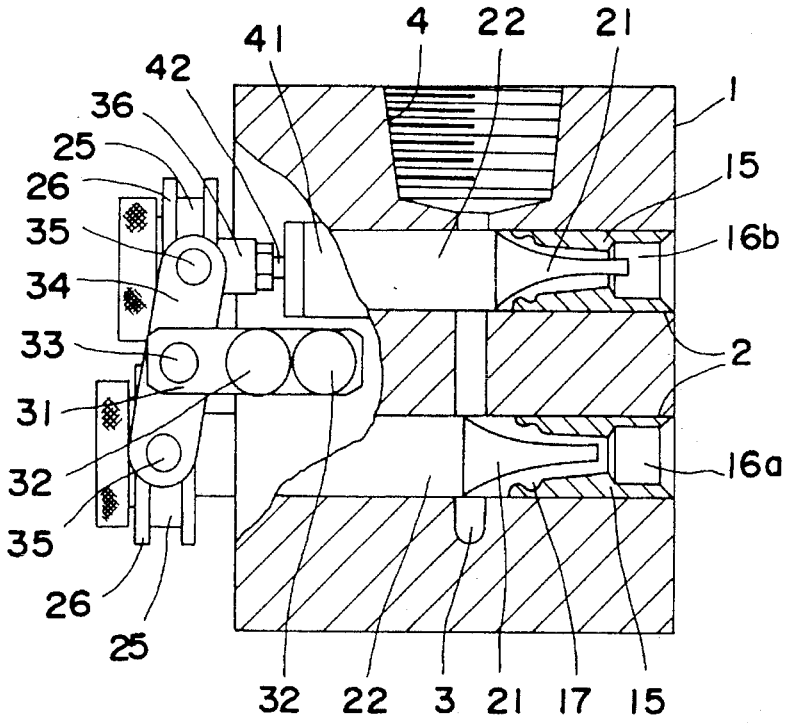
FIG. 5 is a partial cutaway plan view of a modification of the picking device of FIG. 1.

Referring to FIGS. 1 to 4, a picking device in a first embodiment of the present invention has a nozzle body 1 having the shape of a rectangular parallelepipedic block, and is provided with two parallel axial nozzle holes 2 and a liquid chamber 3 having an axis perpendicular to those of the two parallel axial nozzle holes 2. An internal taper pipe thread 4 is formed in the open end of the liquid chamber 3 and the end of a water supply pipe 6 is screwed into the open end of the liquid chamber 3 to connect a pump 5 to the nozzle body 1 of the picking device as shown in FIG. 4. A set of sleeves, i.e., a front sleeve 11 and a rear sleeve 12, having a high degree of hardness are fitted in each axial nozzle hole 2 respectively through the opposite ends of the axial nozzle hole 2 so that an annular port 14 is formed between the respective inner ends of the sleeves 11 and 12.

Straightening orifice chips 15 are fixedly fitted respectively in the front sleeves 11. The straightening orifice chips 15 are provided in their front ends with orifices **16*a* and 16*b*, respectively. The straightening orifice chips 15 have straightening parts 17 tapered toward the orifices 16*a* and 16*b***, respectively.

Spools 22 each having a conical front end 21 are fitted slidably in the sleeves 12, respectively. Each spool 22 is provided with an axial through hole 23 therethrough, and an external thread 24 on the circumference of the rear end thereof. A ring 26 provided with an annular groove 25 in its outer circumference and an internal thread in its inner circumference is screwed onto the rear end of the spool 22.

A bracket 31 is fastened to the rear end of the nozzle body 1 with screws 32 at a position between the two axial nozzle holes 2 so as to extend in parallel to the axes of the axial nozzle holes 2. A swing plate 34 is joined pivotally at its middle point to the rear side of the bracket 31 with a pin 33. Guide pins 35 are attached to opposite sides of the swing plate 34 so that the lower extremities of thereof can be fitted respectively in the annular grooves 25 of the rings 26.

As shown in FIG. 3, one of the guide pins 35 has an upper portion projecting upward from the swing plate 34, a bearing sleeve 37 is put on the upper portion of the guide pin 35, and a head block 36 is put on the bearing sleeve 37 so that the head block 36 is able to turn on the upper portion of the guide pin 35. One end of the operating rod 42 of a linear solenoid actuator 41 attached to the nozzle body 1 is connected to the head block 36. When the operating rod 42 is reciprocated, the swing plate 34 is turned alternately clockwise and counterclockwise, as viewed in FIG. 1.

Two weft yarns (not shown) are passed through the nozzle holes 23 of the two spools 22 so that the ends of the weft yarns peek out of the orifices **16*a* and 16*b***, respectively, to prepare the weft yarns for picking.

Figure 1:
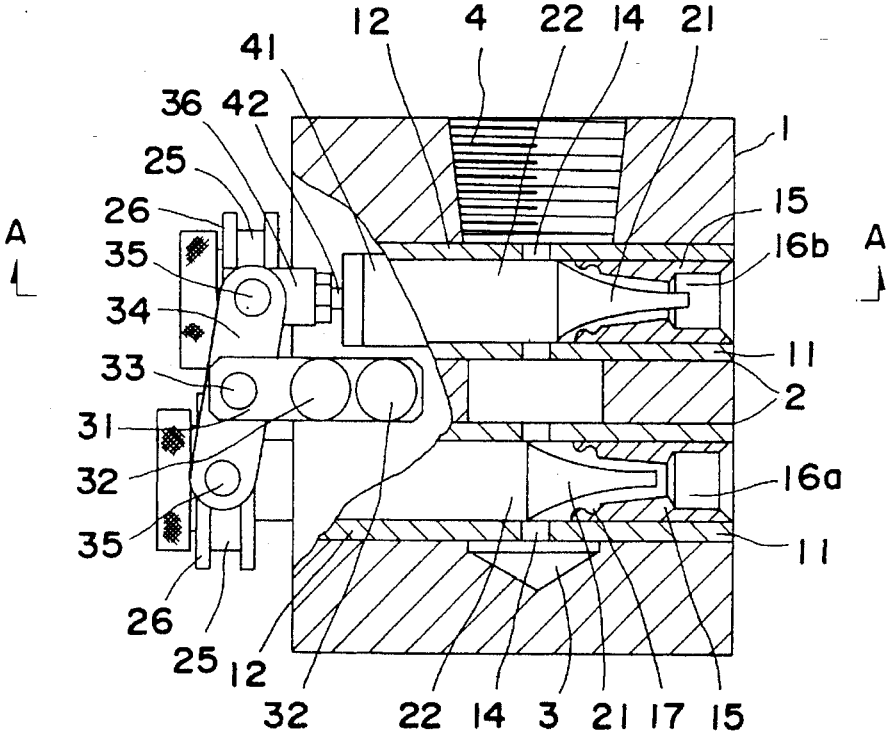
FIG. 1 is a partial cutaway plan view of a picking device in a first embodiment of the present invention for a water-jet loom.

The pump 5 supplies pressurized water through the water supply pipe 6 into the liquid chamber 3 so that a fixed water pressure prevails in the water supply system. When the picking device is in the initial state as shown in FIG. 1, the upper spool 22 is advanced, the upper annular port 14 is closed by the upper spool 22 to disconnect the orifice **16*b* from the liquid chamber 3, and the lower spool 22 is retracted to allow the lower orifice 16*a* to communicate with the liquid chamber 3 by means of the lower port 14. When the linear solenoid actuator 41 is energized to project the operating rod 42, i.e., to move the operating rod 42 to the left as viewed in FIG. 2, the swing plate 34 is turned counterclockwise as viewed in FIG. 1 to retract the upper spool 22 and to advance the lower spool 22. Consequently, the pressurized water is jetted in a water jet through the upper orifice 16***b* to pick the weft yarn at a high velocity into the shed, while the pressurized water is not jetted at all through the lower orifice 16*a*. When the operating rod 42 of the solenoid actuator 41 is retracted, the upper spool 22 is advanced and the lower spool 22 is retracted to positions shown in FIG. 1; consequently, the lower orifice 16*a* is allowed to communicate with the liquid chamber 3 by means of the lower annular port 14 and the weft yarn is picked into the shed by the pressurized water jetted in a water jet through the lower orifice 16*a*. The operating rod 42 is reciprocated to let pressurized water in water jets alternately through the orifices 16*a* and 16*b* to pick the weft yarns successively.

The rear sleeves 12 and the spools 22 are finished so that the clearance between each rear sleeve 12 and the corresponding spool 22 is in the range of about 1 μm to 5 μm. Furthermore, the sleeves 11 and 12 are formed of an abrasion-resistant material of considerable hardness and are barely susceptible to thermal deformation. Accordingly, the pressurized water will not leak through the clearance between each rear sleeve 12 and the corresponding spool 22.

The picking device need not necessarily be provided with the sleeves 11 and 12. A modification of the picking device of FIG. 1 is not provided with any sleeves, and spools 22 are fitted in the axial nozzle holes 2 of a nozzle body 1.

A picking device provided with three spools 22 may be provided with three solenoid actuators respectively for operating the three spools 22, and the solenoid actuators may be driven in sequence to pick weft yarns sequentially through the three spools 22.

Second Embodiment

Figure 6:
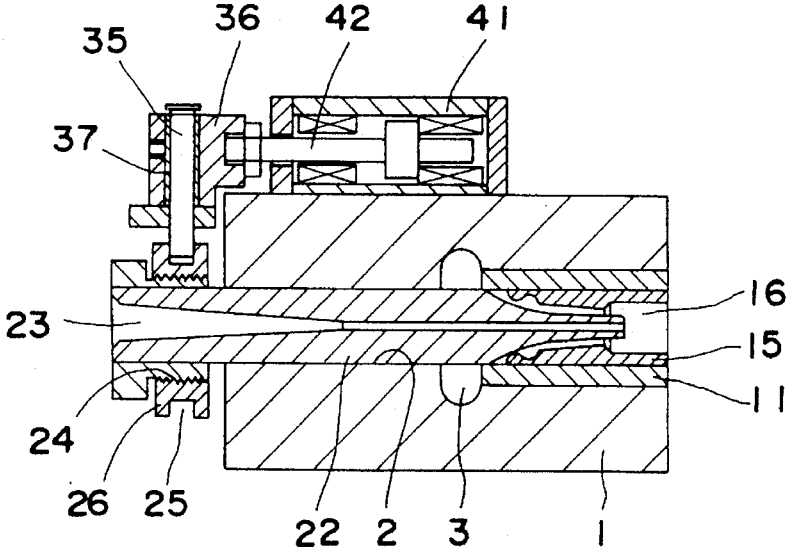
FIG. 6 is a sectional view, similar to FIG. 2, of a picking device in a second embodiment of the present invention.

Referring to FIG. 6, a picking device in a second embodiment of the present invention has a nozzle body 1 provided with stepped, axial nozzle holes 2 each having a rear part and a front part having a diameter greater than that of the rear part. No sleeves are fitted in the axial nozzle holes 2, while spools 22 are fitted directly in the axial nozzle holes 2. Front sleeves 11 are fixedly fitted respectively in the front parts of the axial nozzle holes 2, and straightening orifice chips 15, each having an orifice 16, are fixedly fitted respectively in the front sleeves 11. The front parts of the spools 22 are extended respectively within the straightening orifice chips 15.

In the state shown in FIG. 6, the front portion of the spool 22 is fitted in the front sleeve 11 to disconnect an oval liquid chamber 3 from the orifice 16 of the straightening orifice chip 15. When the operating rod 42 of a linear solenoid actuator 41 is moved to the left, as viewed in FIG. 6, the front portion of the spool 22 is drawn out of the front sleeve 11 to allow the pressurized water to flow from the oval liquid chamber 3 toward the orifice 16, so that the pressurized water is jetted in a water jet.

Figure 7:
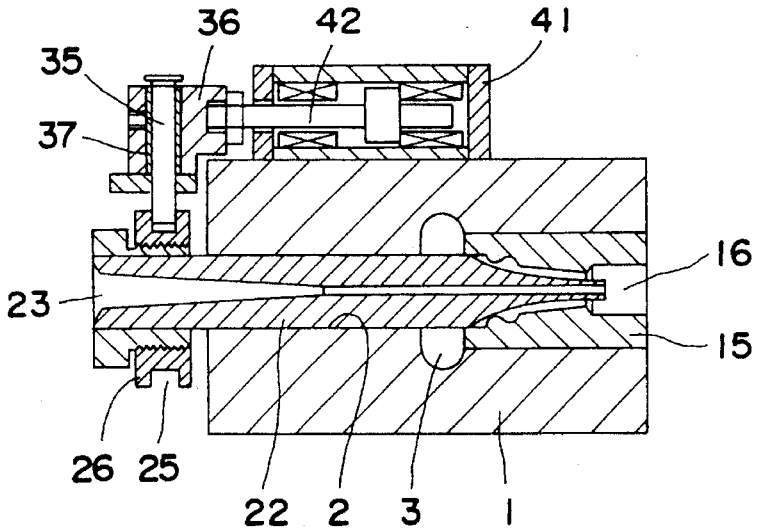
FIG. 7 is a sectional view, similar to FIGS. 2 and 6, of a modification of the picking device of FIG. 6.

As shown in FIG. 7, a modification of the picking device in the second embodiment shown in FIG. 6 is provided with a straightening orifice chip 15, which is equivalent to an integral combination of the sleeve 11 and the straightening orifice chip 15 of the picking device of FIG. 6. The functions of the components of this picking device are the same as those of the picking device of FIG. 6.

In the picking devices shown in FIGS. 6 and 7, the spools 22 are in direct sliding contact with the inner circumferences of the corresponding axial nozzle holes 2. The oval liquid chamber 3 is formed by electric discharge machining or the like so as to be connected to an inlet hole provided with an internal taper pipe thread.

Third Embodiment

Figure 8:
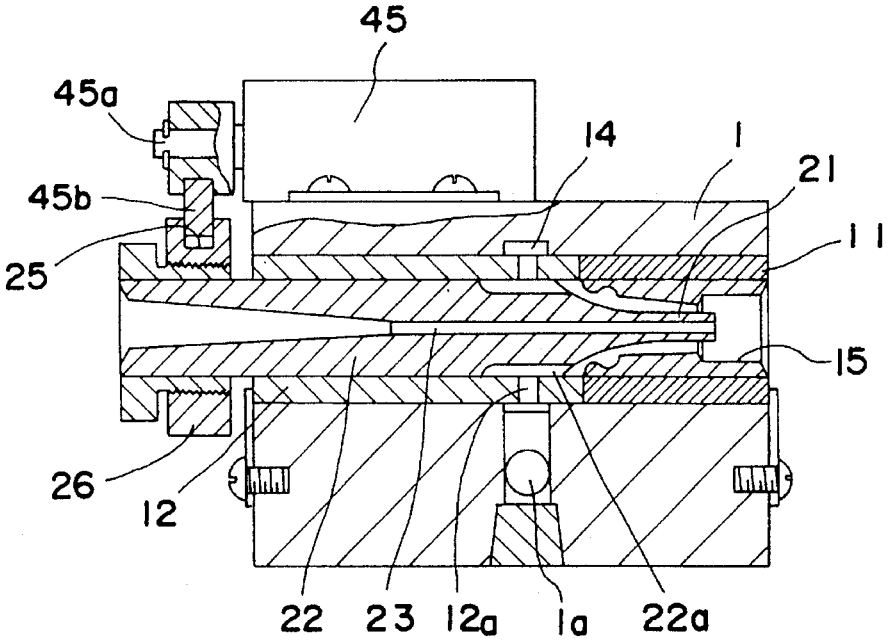
FIG. 8 is a sectional view of a picking device in a third embodiment of the present invention.
Figure 9:
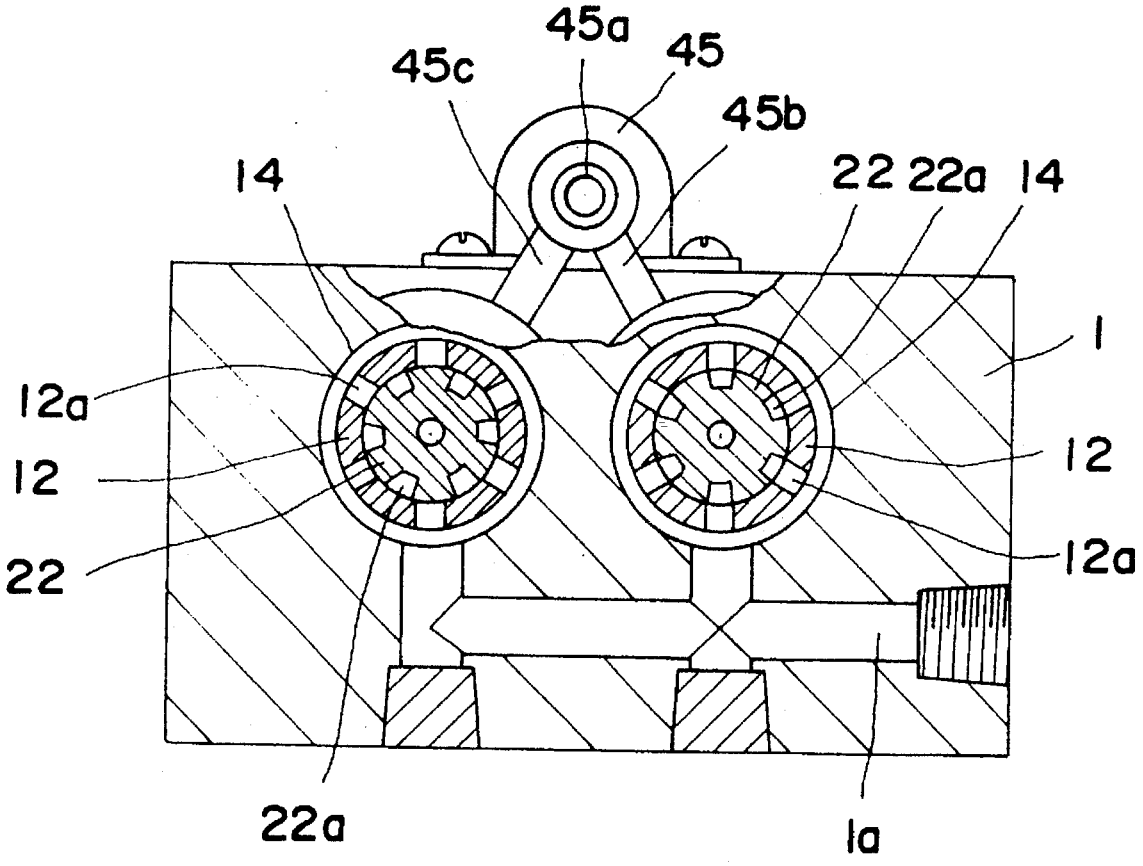
FIG. 9 is a left side view of the picking device of FIG. 8.

A picking device in a third embodiment of the present invention shown in FIG. 8 is similar in construction to the picking device in the first embodiment shown in FIGS. 1 to 3. Referring to FIG. 8, the picking device has a nozzle body 1 provided with axial nozzle holes 2, and a front sleeve 11 and a rear sleeve 12 fixedly fitted in each of the axial nozzle holes 2 of the nozzle body 1. As shown in FIG. 9, six radial inlet holes 12a are formed in the rear sleeve 12 at equal angular intervals, the nozzle body 1 is provided with annular ports 14 and a water supply hole 1*a* connected to the annular ports 14.

A spool 22 fitted in each rear sleeve 12 is rotatable about its axis and is restrained from movement along the axis. Six longitudinal grooves 22a are formed at equal angular intervals in the circumference of the front part of the spool 22 between a section corresponding to the inlet holes 12*a* and a conical section 21.

A rotary solenoid actuator 45 for turning the two spools 22 about their axes is attached to the outer surface of the nozzle body 1. The rotary solenoid actuator 45 has a drive shaft 45*a* capable of being turned in opposite directions and rods 45*b* and 45*c* connected to the drive shaft 45*a* having free ends received in the annular grooves 25 of a ring 26 fixed to the rear end of the spool 22.

FIG. 8 shows the right-side-positioned spool 22 in a state shown in FIG. 9. In the state shown in FIG. 9, the longitudinal grooves 22*a* of the right spool 22 are in alignment respectively with the inlet holes 12*a* of the sleeve 12, so that the pressurized water is able to flow through the water supply passage 1*a*, the annular port 14, the inlet holes 12*a* and the longitudinal grooves 22*a* of the spool 22 into the orifice of a straightening orifice chip 15 fixedly fitted in the front sleeve 11, while the longitudinal grooves 22*a* of the left-side-positioned spool 22 are out of alignment with the inlet holes 12*a* of the corresponding sleeve 12 and hence the pressurized water is unable to flow into the orifice of a straightening orifice chip 15 fixedly fitted in the corresponding front sleeve 11.

When the rotary solenoid actuator 45 is driven to turn the spools 22 about their axes through an angle of about 30°, the positional relation between the right and left spools 22 is reversed and, consequently, the pressurized water is able to flow into the orifice of the straightening orifice chip 15 associated with the left spool 22, as viewed in FIG. 9. The drive shaft 45*a* of the rotary solenoid actuator 45 is turned alternately in opposite directions to pick the weft yarns alternately through the two spools 22.

Naturally, the linear solenoid actuator 41 or the rotary solenoid actuator 45 employed in the foregoing embodiments may be substituted for by any suitable spool driving mechanism.

Fourth Embodiment

A picking device in a fourth embodiment of the present invention is provided with a sliding valve mechanism is described as following.

Figure 10:
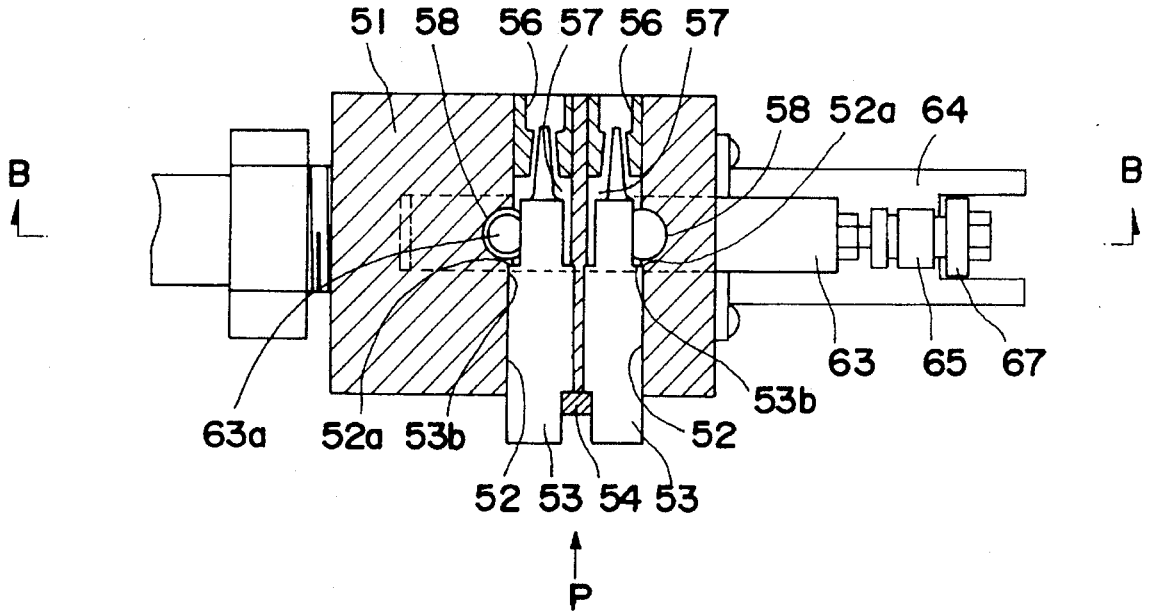
FIG. 10 is a sectional view of a picking device in a fourth embodiment of the present invention.
Figure 11:
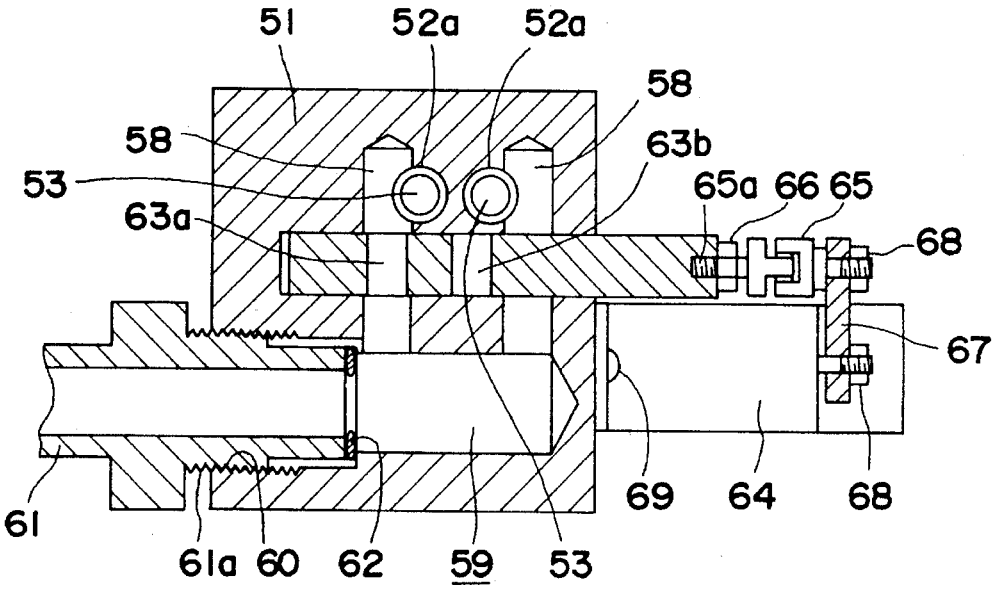
FIG. 11 is a sectional view taken on line B—B in FIG. 10.
Figure 12:
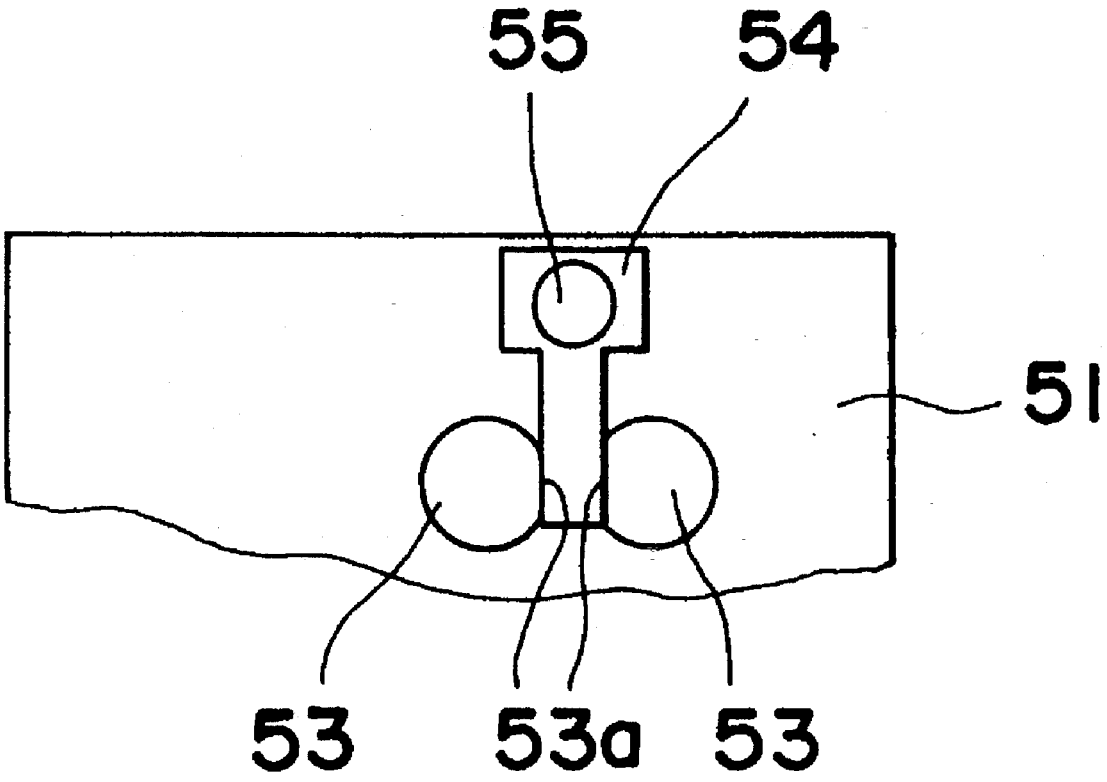
FIG. 12 is a perspective view shown in the direction of the arrow P in FIG. 11.

Referring to FIGS. 10 and 11, a nozzle body 51 is provided with two parallel axial nozzle holes 52, and two spools 53 are fixedly fitted respectively in the two axial nozzle holes 52 with the shoulders 53*b* thereof in contact with the stepped part 52*a* of the axial nozzle holes 52. Linearly cut shaped recesses 53*a*, as shown in FIG. 12, are formed in the rear parts of the spools 53, respectively, and a retaining plate 54 is fastened to the nozzle body 51 with a screw 55 so as to engage the recesses 53*a* of the spools 53 to restrain the spools 53 from turning about their axes.

The orifice of a straightening orifice chip 56 fixedly fitted in the front end of each axial nozzle hole 52 so as to surround the tapered front part of the spool 53 communicates with a space 57 formed behind the inner end of the straightening orifice chip 56. The spaces 57 communicate with a water supply hole 59 by means of two inlet ports or branch passages 58, respectively. The externally threaded end 61*a* of a water supply pipe 61 is screwed in an internally threaded inlet hole 60 formed in the nozzle body 51 to supply the pressurized water through the water supply pipe 61 to both inlet ports 58. In FIG. 11, indicated at 62 is a sealing O ring.

A sliding valve mechanism is incorporated into the nozzle body 51 to open the two inlet ports 58 alternately. The sliding valve mechanism has a sliding valve shaft 63 and a linear solenoid actuator 64 for reciprocating the valve shaft 63 in directions perpendicular to the axes of the inlet ports 58. The valve shaft 63 is provided with two openings 63*a* and 63*b* arranged at a center distance shorter than that of the inlet ports 58. In a state shown in FIG. 11, the left inlet port 58 is open and the right inlet port 58 is closed. The valve shaft 63 is reciprocated to open the two inlet ports 58 alternately.

The valve shaft 63 is connected to the operating rod of the linear solenoid actuator 64, fastened to the nozzle body 51 with screws 69 by a floating joint 65, to enable the linear solenoid actuator 64 to reciprocate the valve shaft 63 smoothly. The floating joint 65 has one externally threaded end 65*a* screwed into the valve shaft 63 and locked in place with a locking nut 66, and the other externally threaded end fastened with a nut 68 to one end of a connecting plate 67 whose other end is connected to the operating rod of the linear solenoid actuator 64.

In the state shown in FIG. 11, the pressurized water supplied by a pump flows through the left inlet port 58 and is jetted through the orifice of the left straightening orifice chip 56 in a water jet to pick the weft yarn through the left spool 53. The valve shaft 63 is reciprocated to open the inlet ports 58 alternately and to pick the weft yarns alternately through the right and left spools 53. It is also possible to control the linear solenoid actuator 64 optionally according to pressurized water supply timing signals to pick the two weft yarns in a desired sequence instead of alternately picking the two weft yarns. Since the clearances between the spools 53 and the nozzle body 51 and between the valve shaft 63 and the nozzle body 51 are in the range of about 3 to about 5 μm, the pressurized water will not leak through the clearances.

Fifth Embodiment

A picking device in a fifth embodiment of the present invention is provided with a reciprocating valve mechanism instead of the sliding valve mechanism employed in the fourth embodiment, but is substantially the same in construction as the picking device in the fourth embodiment in other respects.

The picking device in the fifth embodiment will be described hereinafter with reference to FIGS. 13 and 14, in which parts like or corresponding to those shown in FIGS. 10 and 11 are denoted by the same reference characters and the description thereof will be omitted.

Figure 13:
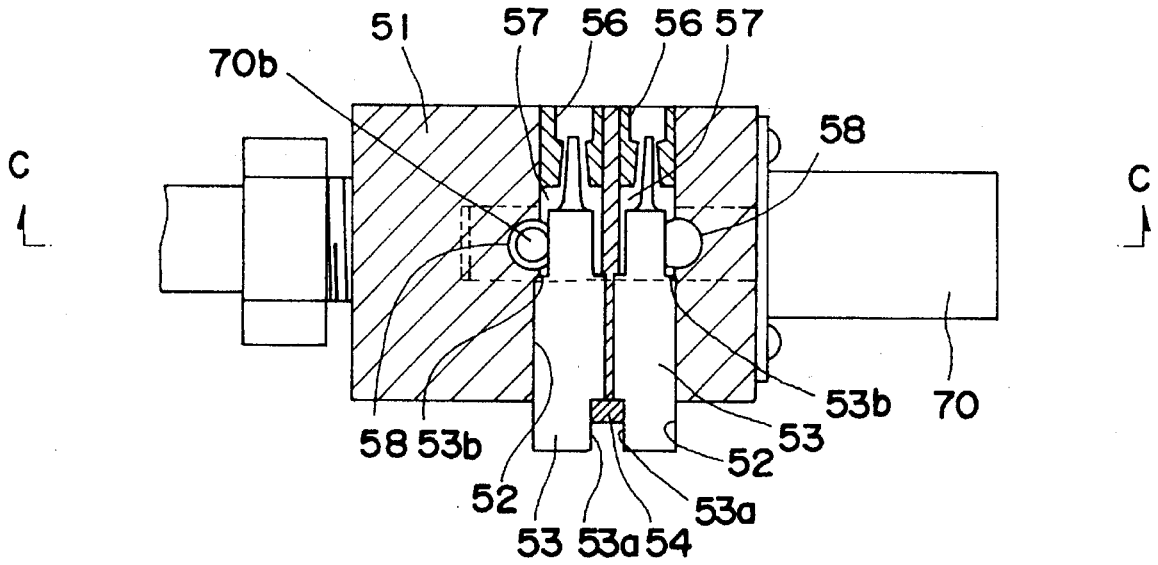
FIG. 13 is a sectional view of a picking device in a fifth embodiment of the present invention.
Figure 14:
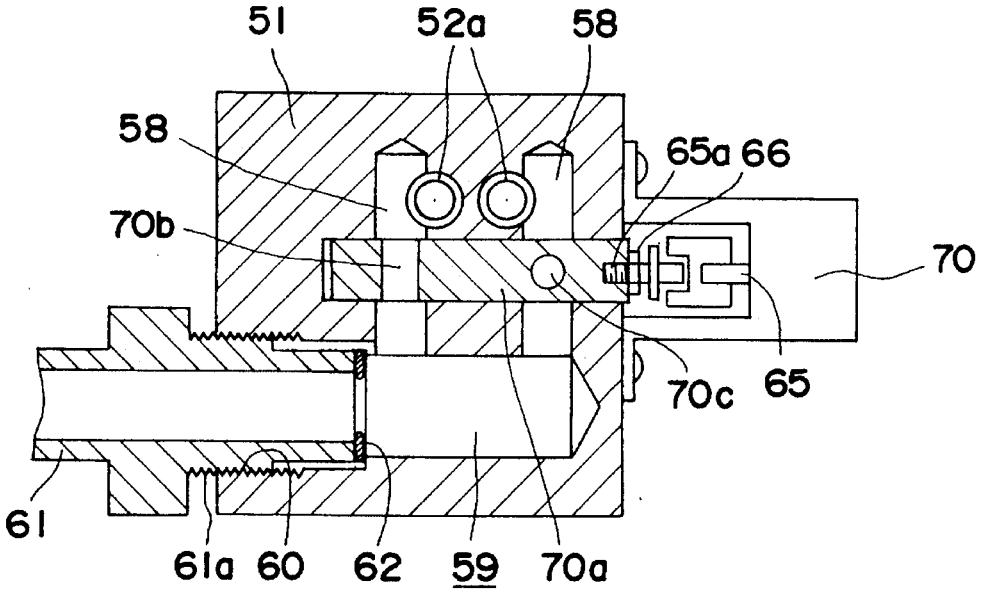
FIG. 14 is a sectional view taken on line C—C in FIG. 13.

Referring to FIGS. 13 and 14, a rotary solenoid actuator 70 is attached to the outer surface of a nozzle body 51, and the operating rod of the rotary solenoid actuator 70 is connected to one axial end of a rotary valve element 70*a* by a floating joint 65. The rotary valve element 70*a* is provided with two diametrical inlet holes 70*b* and 70*c* at positions respectively corresponding to the inlet ports 58 of the nozzle body 51. The axes of the inlet holes 70*b* and 70*c* are perpendicular to each other. In a state shown in FIG. 14, the axis of the left inlet hole 70*b* is in alignment with that of a left inlet port 58 to allow the pressurized water to flow from a water supply passage 59 through the left inlet port 58 into the orifice of a left orifice 56 to pick the weft yarn through a left spool 53. When the rotary valve element 70*a* is turned from its original position shown in FIG. 14 to an angle of 90° the axis of the right inlet hole 70*c* is aligned with that of the right inlet port 58 to allow the pressurized water to flow from the water supply passage 59 through the right inlet port 58 into the right orifice 56 to pick the weft yarn through the right spool 53. The rotary valve element 70*a* may be turned in one direction to an angle of 90° at a time or may be turned alternately in opposite directions within an angular range of 90° to pick the weft yarn alternately through the right and left spools 53.

A modification of the picking device in the fourth embodiment shown in FIGS. 10 and 11 will be described hereinafter with reference to FIG. 15, in which parts like or corresponding to those shown in FIGS. 10 and 11 are denoted by the same reference characters and the description thereof will be omitted. The picking device shown in FIG. 15 is substantially the same in construction as the picking device shown in FIGS. 10 and 11, except that the axis of one of the two axial nozzle holes of the former is inclined towards that of the other.

Figure 15:
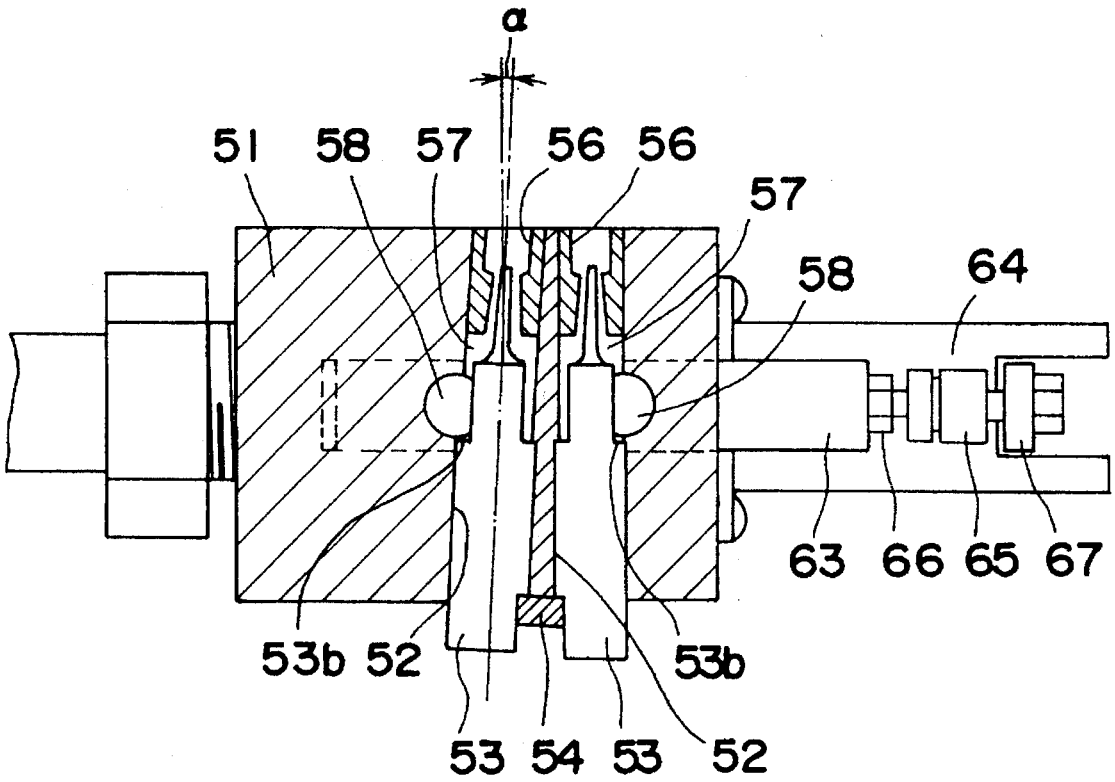
FIG. 15 is a sectional view of a modification of the picking device of FIG. 11.

Referring to FIG. 15, a nozzle body 51 is provided with two axial nozzle holes 52. The axis of one of the axial nozzle holes 52, i.e., the right-side-positioned axial nozzle hole 52 as viewed in FIG. 15, is parallel to the width of the water-jet loom, and the axis of the other axial nozzle hole 52, i.e., the left-side-positioned axial nozzle hole 52 as viewed in FIG. 15, is inclined at an angle α of about 1.5° at a maximum to the axis of the right axial nozzle hole 52 so that the axes of the axial nozzle holes 52 of the nozzle body 1 placed on one side of the fabric on the water-jet loom intersect each other on the other side of the fabric. The angle between the axes of the two axial nozzle holes 52 is determined according to the width of the waterjet loom. Thus, the jets of the pressurized fluid jetted through the spools converge.

Figure 16:
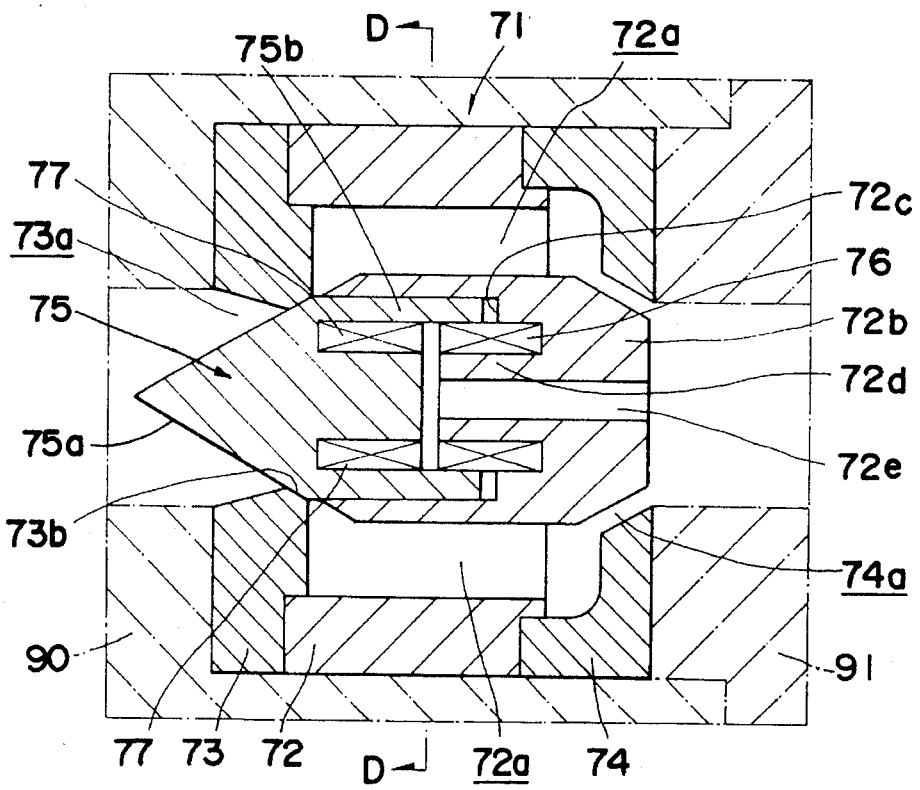
FIG. 16 is a sectional view of a shutoff valve provided in a pressurized water supply line connecting a pump to the picking device of a water-jet loom.

FIG. 16 shows a shutoff valve provided in a pressurized water supply line connecting a pump to the picking device of a water-jet loom. Referring to FIG. 16, the shutoff valve has a valve housing 71 contained in a socket 90 and is held therein with a cap 91. The valve housing 71 consists of a retainer 72, a valve seat ring 73 fixedly joined to one end of the retainer 72, and a guide ring 74 fixedly joined to the other end of the retainer 72. The retainer 72 is provided with a plurality of axial holes 72*a* arranged in a circle at equal angular intervals, and a central hole. A guide block 72*b* is fitted in the central hole of the retainer 72, and a valve element 75 is axially slidably fitted in the guide hole of the guide block 72*b*. A circular seat 72*c* is formed on the bottom surface of the guide hole of the guide block 72*b* to limit the axial movement of the valve element 75 in one direction. The guide block 72*b* has a cylindrical wall 72*d* coaxial with the circular seat 72*c* and having an axial passage 72*e*. A permanent magnet 76 is fitted in an annular space between the circular seat 72*c* and the cylindrical wall 72*d*.

The valve element 75 has a tapered end 75*a* partly projecting into the central hole 73*a* of the circular valve seat ring 73. The valve element 75 has a cylindrical wall 75*b* axially slidably fitted in the central hole of the guide block 72*b*, and an inner boss. A permanent magnet 77 of a polarity reverse to that of the permanent magnet 76 is fitted in an annular space between the cylindrical wall 75*b* and the inner boss of the valve element 75. The valve element 75 is biased to the left, as shown in FIG. 16, and held at a shutoff position by the repulsive force between the permanent magnets 76 and 77 to close the shutoff valve when the pressure of the pressurized water is not applied to the valve element 75.

A tapered valve seat 73*b* corresponding to the tapered end 75*a* of the valve element 75 is formed around the central hole 73*a* of the valve seat ring 73. In FIG. 16, the end face of the cylindrical wall 75*b* is separated from the circular seat 72*c* by a distance corresponding to the stroke of the valve element 75.

The guide ring 74 is provided with a central hole 74*a* to form an annular passage between the guide ring 74 and the guide block 72*b*.

A pump connected to the socket 90 by a water supply line operates synchronically with the operation of the water-jet loom to supply pressurized water. Then, the valve element 75 is forced to move to the right, as viewed in FIG. 16, against the repulsive force between the permanent magnets 76 and 77 by the pressure of the pressurized water, the tapered end 75*a* of the valve element 75 is separated from the valve seat 73*b* and, consequently, the pressurized water flows through the axial holes 72*a* of the retainer 72, through the outlet hole of the cap 91 and through a water supply line into the picking device. When the supply of the pressurized water by the pump is interrupted, the tapered end 75*a* of the valve element 75 is forced to be seated on the valve seat 73*b* of the valve seat ring 73 by the repulsive force between the permanent magnets 76 and 77 to close the shutoff valve.

The shutoff valve is opened and closed by the pressure of the pressurized water and the repulsive force between the permanent magnets 76 and 77 according to the operation of the pump. Since the valve element 75 is guided for axial movement by the retainer 72, the valve element 75 will not vibrate about its axis when the same is moved by the pressure of the pressurized water or by the repulsive force between the permanent magnets 76 and 77. Therefore, the pressure of the water will not oscillate and pressurized water can be jetted through the picking nozzle for stable picking. Since the vibration of the valve element 75 is suppressed, resistance against the flow of the pressurized water is minimal, pressure loss in the pressurized water flow is reduced, abrasion of the sliding surfaces and the contact surfaces of the valve element 75, the retainer 72 and the valve seat ring 73 is reduced, and the functioning life of the shutoff valve is extended.

Figure 18:
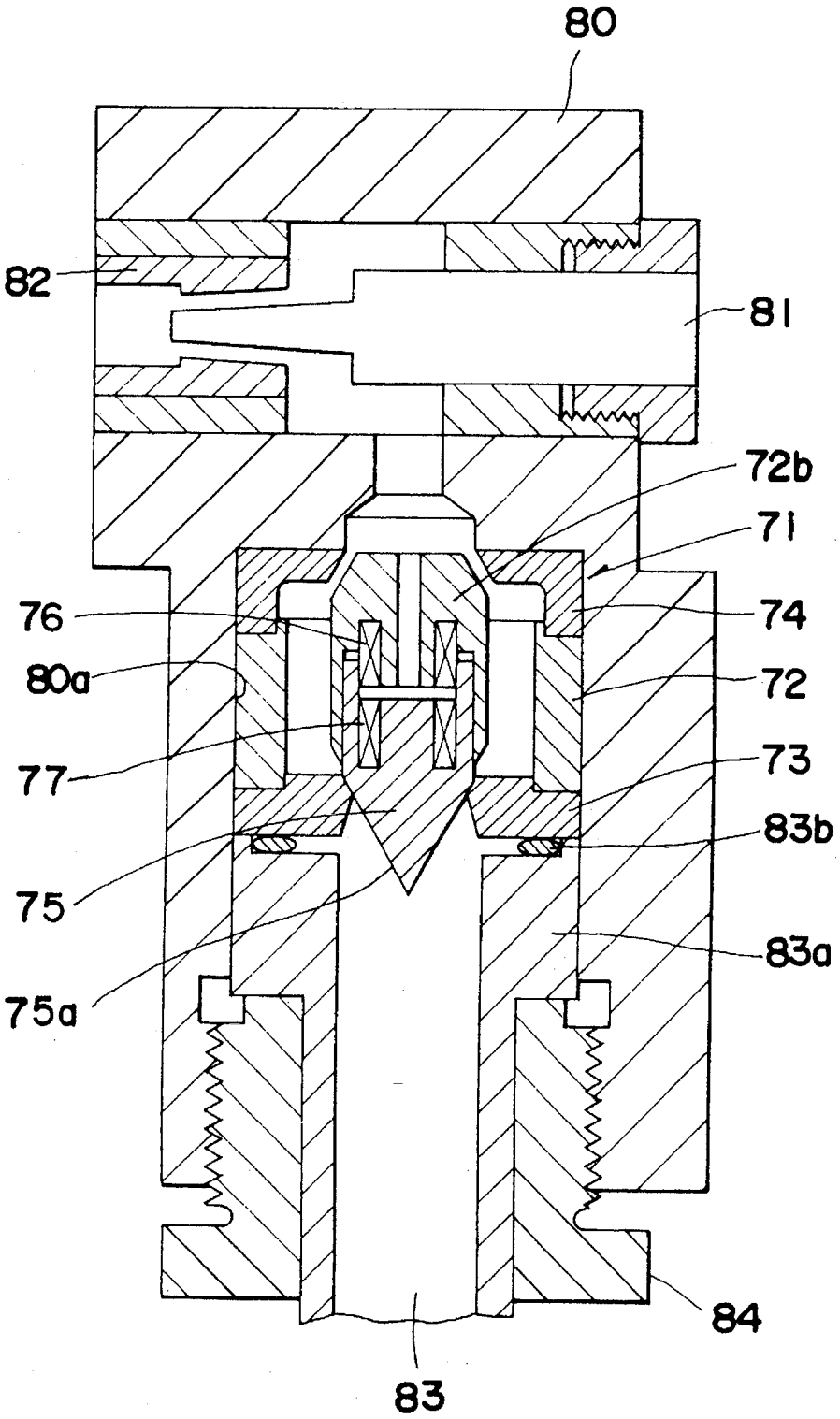
FIG. 18 is a sectional view of an assembly of the shutoff valve of FIG. 16 and a picking device in accordance with the present invention.

Referring to FIG. 18 showing a picking device in accordance with the present invention incorporating the shutoff valve of FIG. 15, the picking device has a nozzle body 80, a spool 81 supported in a substantially horizontal position in a rear sleeve fixedly fitted in an axial nozzle hole formed in the nozzle body 80, and an orifice chip 82 fixedly fitted in the front end of a front sleeve fixedly fitted in the axial nozzle hole so as to surround the front part of the spool 81. The orifice of the orifice chip 82 and the space surrounding the spool 81 are connected to a pressurized water supply passage.

Figure 17:
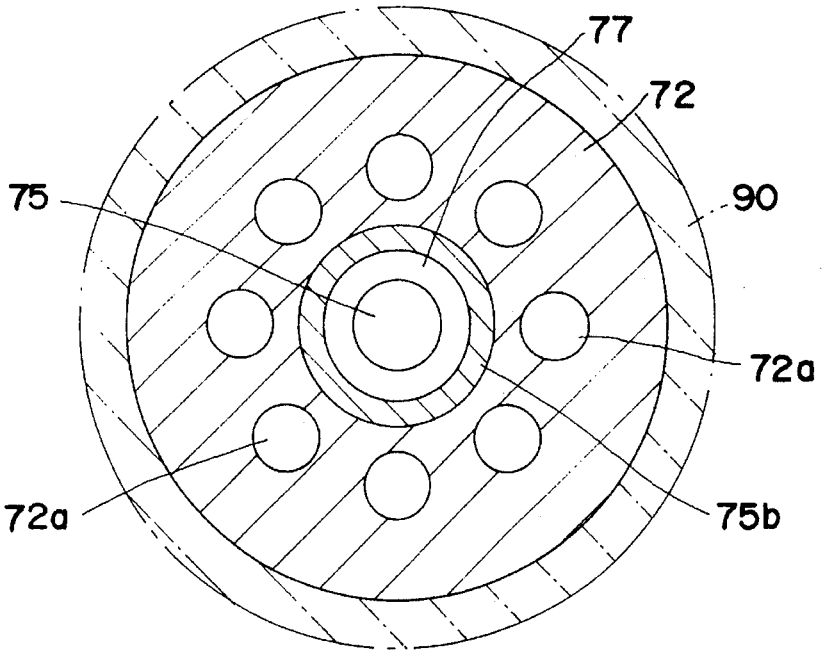
FIG. 17 is a sectional view taken on line D—D in FIG. 16.

Part of the lower wall of the nozzle body 80 is extended downward to form a hollow, tubular housing 80*a* having a lower open end and the interior of the hollow, tubular housing 80*a* is connected through an inlet hole and the space surrounding the spool 81 to the orifice of the orifice chip 82. The valve housing 71 of the shutoff valve shown in FIGS. 16 and 17 is fitted in the hollow, tubular housing 80*a* with the guide ring 74 positioned on the side of the nozzle body 80 and with the valve seat ring 73 positioned on the side of the open lower end of the hollow, tubular housing 80*a*. An O ring 83*b* is seated on the outer surface of the valve seat ring 73, and a flange 83*a* joined to one end of a water supply pipe 83 whose other end is connected to a pump, not shown, is put on the O ring 83*b*, and then a nut 84 put on the water supply pipe 83 is screwed in the lower end of the hollow, tubular housing 80*a* to fasten the flange 83*a* to the housing 71 and to hold the housing 71 fixedly within the hollow, tubular housing 80*a*.

When the shutoff valve is thus combined with the picking device near a position where the pressurized water starts acting on the weft yarn for picking, the distance between the shutoff valve and the outer end of the orifice chip 82 is comparatively small and, consequently, pressure drop across the outlet hole 74*a* of the guide ring 74 and the orifice chip 82 is reduced and the oscillation of the pressure of the pressurized water attributable to bends in the water supply passage can be reduced.

Since the movement of the valve element 75 of the shutoff valve is more stable than the valve element of the conventional ball valve, the variation of the pressure of the pressurized water in the shutoff valve and the resulting oscillation of the pressure within the water supply line are suppressed, so that the weft can be stably picked.

Figure 19:
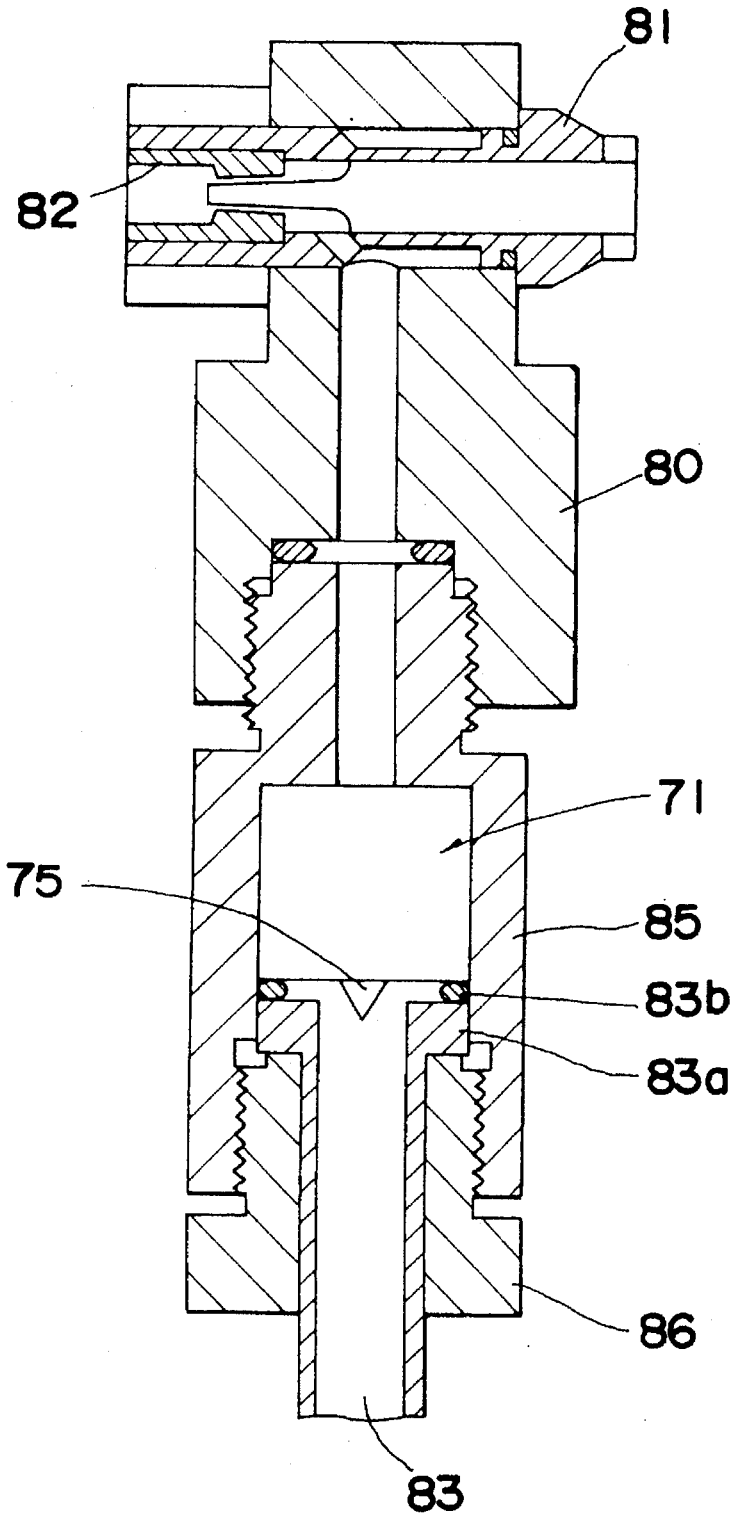
FIG. 19 is a sectional view of an assembly of the shutoff valve of FIG. 16, a picking device in accordance with the present invention and an adapter.

Referring to FIG. 19 showing another structure for combining the shutoff valve shown in FIGS. 16 and 17 and a picking device in accordance with the present invention, an adapter 85 having an outlet passage capable of communicating with the orifice of an orifice chip 82 fixedly fitted in the front end of an axial nozzle hole formed in a nozzle body 80 is joined to the nozzle body 80 of the picking device, and the housing 71 of the shutoff valve is contained in the adapter 85. A flange 83*a* put on one end of a water supply pipe 83 which has the other end connected to a pump, is fastened to the outer surface of the valve seat ring 73 of the housing 71 with an O ring 83*b* therebetween and with a nut 86 screwed in the lower end of the adapter 85 to connect the water supply pipe 83 to the shutoff valve.

Although the distance between the shutoff valve and the orifice chip 82 in this assembly of the picking device is longer than that in the assembly of the same shown in FIG. 18, the valve element 75 suppresses the oscillation of the pressurized water and the weft yarn can be satisfactorily picked.

Figure 20:
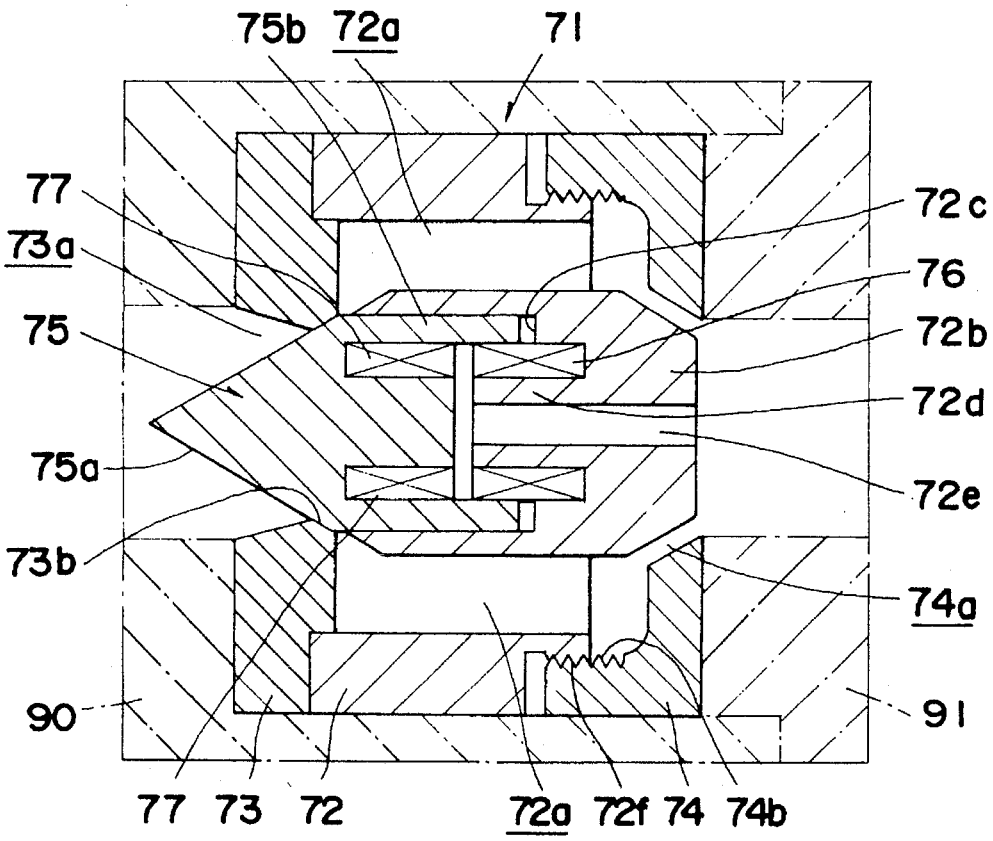
FIG. 20 is a sectional view of another shutoff valve.
Figure 21:
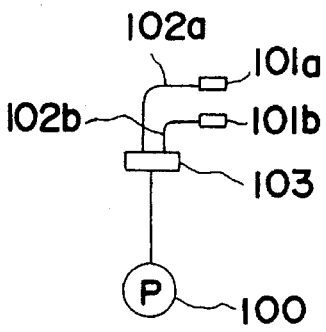
FIG. 21 PRIOR ART
FIG. 21 is a diagrammatic view of a conventional picking system provided with two picking devices.

Another shutoff valve shown in FIG. 20 is similar in construction to the shutoff valve shown in FIG. 16, except that the former shutoff valve is capable of adjusting the flow of the pressurized water. As shown in FIG. 20, the shutoff valve has a housing 71 consisting of a retainer 72, a valve seat ring 73 fixedly joined to one end of the retainer 72 and a guide ring 74 joined to the other end of the retainer 72 by the engagement of an external thread 72*f* formed in the outer circumference of the other end of the retainer 72 and an internal thread 74*b* formed in the inner circumference of the guide ring 74. The arrangement and functions of a guide block 72*b*, a valve element 75 and the permanent magnets 76 and 77 are the same as those of the corresponding components of the shutoff valve of FIG. 15.

An annular passage is formed between the tapered end of the guide block 72*b* and the tapered central hole of the guide ring 74. The sectional area of the annular passage is adjustable by turning the guide ring 74 relative to the retainer 72 to adjust the axial position of the guide ring 74 relative to the guide block 72*b*. The flow of the pressurized water can be adjusted according to water supply conditions, the capacity of the pump, and the picking force necessary for picking the weft yarn, by adjusting the axial position of the guide ring 74 relative to the guide block 72*b* to jet the pressurized water in an optimum water jet. The assemblies shown in FIGS. 17 and 18 may employ the shutoff valve shown in FIG. 20 instead of the shutoff valve shown in FIGS. 18 and 19.

Using the repulsion between the permanent magnets for biasing the valve element toward the shutoff position enables the valve element to be moved stably for opening and closing the shutoff valve without causing pulsation of the pressurized water and, consequently, the weft yarn can be satisfactorily picked by the agency of the water jet.

Furthermore, since the valve element is biased toward the shutoff position by the repulsion between the permanent magnets, with no mechanical means such as springs or the like being necessary, the shutoff valve provides high durability, has a compact construction, and enables more freedom of design.

The flow adjusting capability of the shutoff valve enables the appropriate adjustment of the water jet according to the kind of weft yarn.

The picking device of the present invention enhances the weaving speed and the efficiency of the water-jet loom and is capable of picking a plurality of kinds of weft yarns at a high picking speed. For example, the picking device of the present invention is able to pick two weft yarns alternately for satisfactory picking by using the pressurized water supplied thereto by a pump having a discharge pressure in the range of about 70 to about 80 kg/cm$^2$, while the conventional picking device needs a pump having a discharge pressure on the order of 140 kg/cm$^2$ for the same purpose. Thus, the picking device of the present invention needs a pump having a simple construction and a comparatively low discharge pressure, and is capable of operating with comparatively low power consumption, so that the wear of the pump components is reduced and the pump generates relatively low noise.

Furthermore, since the reduction of pressurized water entails the reduction of the resistance of the water supply system against the flow of the pressurized water, the intensity of water hammer that occurs when the flow of the pressurized water is interrupted is reduced and damage to the weft yarn attributable to water hammer is reduced.

Still further, since pressure loss in the pressurized water is reduced and the resistance of the water supply system is small, the amount of the pressurized water necessary for a water jet is greatly reduced, producing an economic advantage.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A picking device for a water-jet loom, said picking device comprising:

a nozzle body provided with a plurality of axial nozzle holes having front ends, and a fluid supply passage connected to a pressurized fluid source;

a plurality of spools, each having a front end and an axis, each spool provided with an axial through-hole through which a weft yarn advances, and each spool supported for axial sliding movement within the nozzle body;

orifice chips fixedly fitted in the front ends of the axial nozzle holes so as to form straightening flow passages between the orifice chips and the front ends of the corresponding spools, respectively, said orifice chips having orifices; and a spool driving mechanism for individually or sequentially reciprocating the spools along their axes to open and close fluid passages through which the pressurized fluid flows from the fluid supply passage into the orifices of the orifice chips.

2. A picking device for a water-jet loom, said picking device comprising:

a nozzle body provided with a water supply passage connected to a pressurized fluid source;

a plurality of spools, each having a front end and an axis, each spool provided with an axial through-hole through which to pass a weft yarn, and the spools supported for turning about their axes within the nozzle body;

orifice chips fixedly fitted on the nozzle body near the front ends of the spools so as to form straightening flow passages between the orifice chips and the front ends of the corresponding spools, respectively; and a spool driving mechanism for individually or sequentially turning the spools along their axes to open and close water passages through which the pressurized fluid flows from the water supply passage into the orifices of the orifice chips.

3. A picking device for a water-jet loom, said picking device comprising;

a nozzle body provided with a plurality of axial nozzle holes, a single fluid supply hole to be connected to a pressurized fluid source, and a plurality of branch passages connected respectively to the axial nozzle holes;

a plurality of spools each having an axial through-hole and fixedly fitted respectively in the axial nozzle holes;

a valve mechanism for opening and closing the branch passages; and a valve driving mechanism for driving the valve mechanism to open and close the branch passages.

4. A picking device according to claim 1 or 2, wherein each axial nozzle hole has a front part and a rear part, a set of sleeves are fixedly fitted respectively in the front part and the rear part of each axial nozzle hole so that a space is formed between the respective inner ends of the sleeves, and the space between the respective inner ends of the sleeves is used as an inlet port through which the pressurized fluid supplied from the pressurized fluid source flows into the orifice of the orifice chip.

5. A picking device according to claim 1 or 2, wherein a sleeve is fixedly fitted in the front part of each axial nozzle hole to support the front part of the spool for sliding movement.

6. A picking device according to claim 1 or 2, wherein a sleeve is fixedly fitted in the front part of each axial nozzle hole to support the front part of the spool for sliding movement, and the sleeve is integrally provided with the orifice chips.

7. A picking device according to any one of claims 1, 2 or 3, wherein the respective axes of the plurality of axial nozzle holes are inclined respectively at angles to each other so that jets of the pressurized fluid jetted through the spools converge on a predetermined position.

8. A picking device according to claim 1 or 2, wherein each axial nozzle hole has a front part and a rear part, a set of sleeves are fixedly fitted respectively in the front part and the rear part of each axial nozzle hole so that a radial hole is formed in either of the sleeves, and the radial hole formed in either of the sleeves is used as an inlet port through which the pressurized fluid supplied from the pressurized fluid source flows into the orifice of the orifice chip.

* * * * *